US005510815A

United States Patent [19]

Linder et al.

[11] Patent Number: 5,510,815

[45] Date of Patent: Apr. 23, 1996

[54] ADJUSTABLE PEN-TO-PAPER SPACING IN PRINTERS USING BLACK AND COLOR PENS

[75] Inventors: Thomas W. Linder; John Dion, both of Corvallis, Oreg.

[73] Assignee: Hewlett-Packard Company, Palo Alto, Calif.

[21] Appl. No.: 145,354

[22] Filed: Oct. 29, 1993

[51] Int. Cl.[6] ..... B41J 25/308; B41J 2/21

[52] U.S. Cl. ..... 347/8; 347/43

[58] Field of Search ..... 347/8, 19, 43

[56] References Cited

U.S. PATENT DOCUMENTS

| | | | |
|---|---|---|---|
| 4,675,696 | 6/1987 | Suzuki | 347/43 X |
| 4,774,529 | 9/1988 | Paranjpe et al. | 347/43 |

FOREIGN PATENT DOCUMENTS

| | | | |
|---|---|---|---|
| 2-217278 | 8/1990 | Japan | 347/8 |
| 5-104710 | 4/1993 | Japan | 347/8 |

*Primary Examiner*—Benjamin R. Fuller
*Assistant Examiner*—David Yockey

[57] ABSTRACT

In order to optimize print quality, it is desirable to minimize the distance between a inkjet printhead and the media that is being printed on. This reduces print quality degradation by stray drops of ink with different trajectories than the main drop and errors in the nominal trajectory of the main drop. Color inkjet printers commonly employ a plurality of print cartridges, usually either two or four, mounted in the printer carriage to produce a full spectrum of colors. In a multiple printhead printer, it is advantageous if the black print cartridge is closer to the print media when printing text than is the color cartridge when printing color graphics. The apparatus and method of this disclosure enables the black printhead in an inkjet printer with both black and color cartridges to be as close to the media as possible so that black text print quality will be optimized while also allowing the printing of color graphics. Since black text print quality is more sensitive to printhead-to-media distance than is color graphics quality, the overall print quality of both black text and color graphics is optimized.

5 Claims, 9 Drawing Sheets

ADJUSTABLE PEN-TO-PAPER SPACING IN PRINTERS USING BLACK AND COLOR PENS

FIELD OF THE INVENTION

This invention relates generally to the field of thermal inkjet printers and more particularly to improving black text quality in thermal inkjet printers using black and color inkjet pen cartridges.

CROSS-REFERENCE TO RELATED APPLICATIONS

The present invention is related to the following pending and commonly assigned U.S. patent applications: USE OF A DENSITOMETER FOR ADAPTIVE CONTROL OF PRINTHEAD-TO-MEDIA DISTANCE IN INK-JET PRINTERS, by W. Wistar Rhoads, et al., Ser. No. 08/145,019, U.S. Pat. No. 5,414,453, filed Oct. 29, 1993; IMPROVEMENT OF BLACK TEXT QUALITY IN PRINTERS USING MULTIPLE BLACK AND COLOR PENS, by W. Wistar Rhoads, et al., Ser. No. 08/056,959, U.S. Pat. No. 5,455,607, filed May 3, 1993; CARRIAGE SUPPORT FOR COMPUTER DRIVEN PRINTER, by Damon W. Broder, et al., Ser. No. 08/056,639, U.S. Pat. No. 5,368,403, filed Apr. 30, 1993; and IMPROVED MEDIA CONTROL AT INK-JET PRINTZONE, by Robert R. Giles, et al., Ser. No. 08/056,229, U.S. Pat. No. 5,399,039, filed Apr. 30, 1993; which are herein incorporated by reference.

BACKGROUND OF THE INVENTION

Inkjet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkier printers print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkier printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of firing chambers which receive liquid ink from the ink reservoir. Each chamber has a thin-film resistor, known as a inkier firing chamber resistor, located opposite the nozzle so ink can collect between it and the nozzle. The firing of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Color inkjet printers commonly employ either one print cartridge, which may be interchangeable for a black or color print cartridge, or two or more print cartridges, mounted in the printer carriage to produce black print or a full spectrum of colors. In a printer with four cartridges, each print cartridge contains a different color ink, with the commonly used base colors of black, cyan, magenta, and yellow. In a printer with two cartridges, one cartridge usually contains black ink with the other cartridge being a tri-compartment cartridge containing the base colors cyan, magenta and yellow inks. The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

When a number of pixels in a particular area of an absorbent print medium such as bond paper absorb the liquid solvent constituent (typically water) of the ink, the paper fibers in that area will expand until the solvent has evaporated or otherwise dispersed. Because the dampened area of the print medium is typically constrained in the plane of the paper by adjacent less damp areas and/or by the paper advance mechanism and from below by a platen, the dampened area has a tendency to buckle upwards towards the nozzle (a problem referred to as "cockle"). If the height of the buckle exceeds the nominal spacing between the pen and the paper, then the ink in that area will be scraped by the pen as the pen retraces over some or all of the buckled area during a subsequent sweep over the same in the opposite direction (bi-directional and certain color printing modes) or prior to printing a sweep over an overlapping area (multiple pass printing modes). Such scraping causes smearing of the still damp ink and a degradation of image quality.

A related problem is "curling" of the paper. As a result of the differential absorption of solvent on the two sides of the paper, once the paper exits from the feed mechanism, it is no longer under tension and has a tendency to curl. Depending upon the extent of the curl, which is a function of both overall image density and throughput speed, the printed surface will be urged against various stationary parts of the printer between the carriage and the output tray, and at least the densest parts of the image will be smeared.

The print medium becomes damper and remains damp for a longer time as more ink is applied on the same area of the print medium. Thus, the probability of buckling or curling increases when ink density of a print image increases to produce intense black or colored portions of the image. The probability of smearing also increases when the speed of the printer increases and less time is allowed for the ink to dry, or when the distance between the paper and the nozzle is reduced to more accurately define the size and location of the individual dots of ink. Problems associated with scraping of the nozzles against the raised portions of the image are most noticeable during high quality multiple pass printing modes in which the nozzle passes several times over the same area. The curling problem is particularly noticeable in high quality, high throughput (single pass) printing modes in which a large quantity of ink is deposited over a relatively large area in a relatively short time.

Prior printers were designed so that each printhead was the same distance from the media. The distance was determined by adding up the various tolerances such as media cockle height, tolerance between the parts that define the position of the media and the carriage, tolerance from printhead location to printhead location within the carriage, and variation in the distance from the closest part of the printhead to the media to the surface on the print cartridge that locates the printhead in the carriage. These tolerances can require a nominal printhead to media distance that does not produce good print quality due to the increased effects of spray and errors in the nominal trajectory of the main drop.

Moreover, this does not yield optimum print quality for a black and color printer, since the nominal printhead to media distance is identical for the black and color pens. Black text print quality is more sensitive to printhead to media spacing than color graphics and images are, therefore having the black printhead the same distance from the media as the color printhead in order to prevent scraping will produce a lower print quality than could be achieved if it was possible for the black printhead to be closer to the print media when printing text.

Thus, the prior art has failed to provide a satisfactory solution for printing high quality text printing in a printer which also prints high quality color graphics.

SUMMARY OF THE INVENTION

In order to optimize print quality, it is desirable to minimize the distance between a inkjet printhead and the media that is being printed on. This reduces print quality degradation by spray (small, stray drops of ink with different trajectories than the main drop) and errors in the nominal trajectory of the main drop. Color inkier printers commonly employ a plurality of print cartridges, usually either two or four, mounted in the printer carriage to produce a full spectrum of colors. In a multiple printhead printer, it is advantageous if the black print cartridge is closer to the print media when printing text than is the color cartridge when printing color graphics.

The foregoing objectives and advantages are achieved by this invention which provides the following apparatus and method. An inkier printer carriage comprising a black pen receptacle; at least one color pen receptacle; means for sensing a pen in said color receptacle; and means for adjusting the height of a pen in said black pen receptacle upon the sensing of a pen in said color receptacle. A method for improving print quality in an inkjet printer comprising the steps of setting a printhead to media distance of a black pen initially to a first value for black text printing; determining whether a color pen is installed; leaving the printhead to media distance of the black pen at said first value if a color pen is not installed; and changing the printhead to media distance of the black pen to a second value if a color pen is installed.

The apparatus and method of this invention enables the black printhead in an inkjet printer with both black and color cartridges to be as close to the media as possible so that black text print quality will be optimized. Since black text print quality is more sensitive to printhead-to-media distance than is color graphics quality, the overall print quality of both black text and color graphics is optimized.

DETAILED DESCRIPTION OF THE PREFERRED EMBODIMENT

Figure 1:
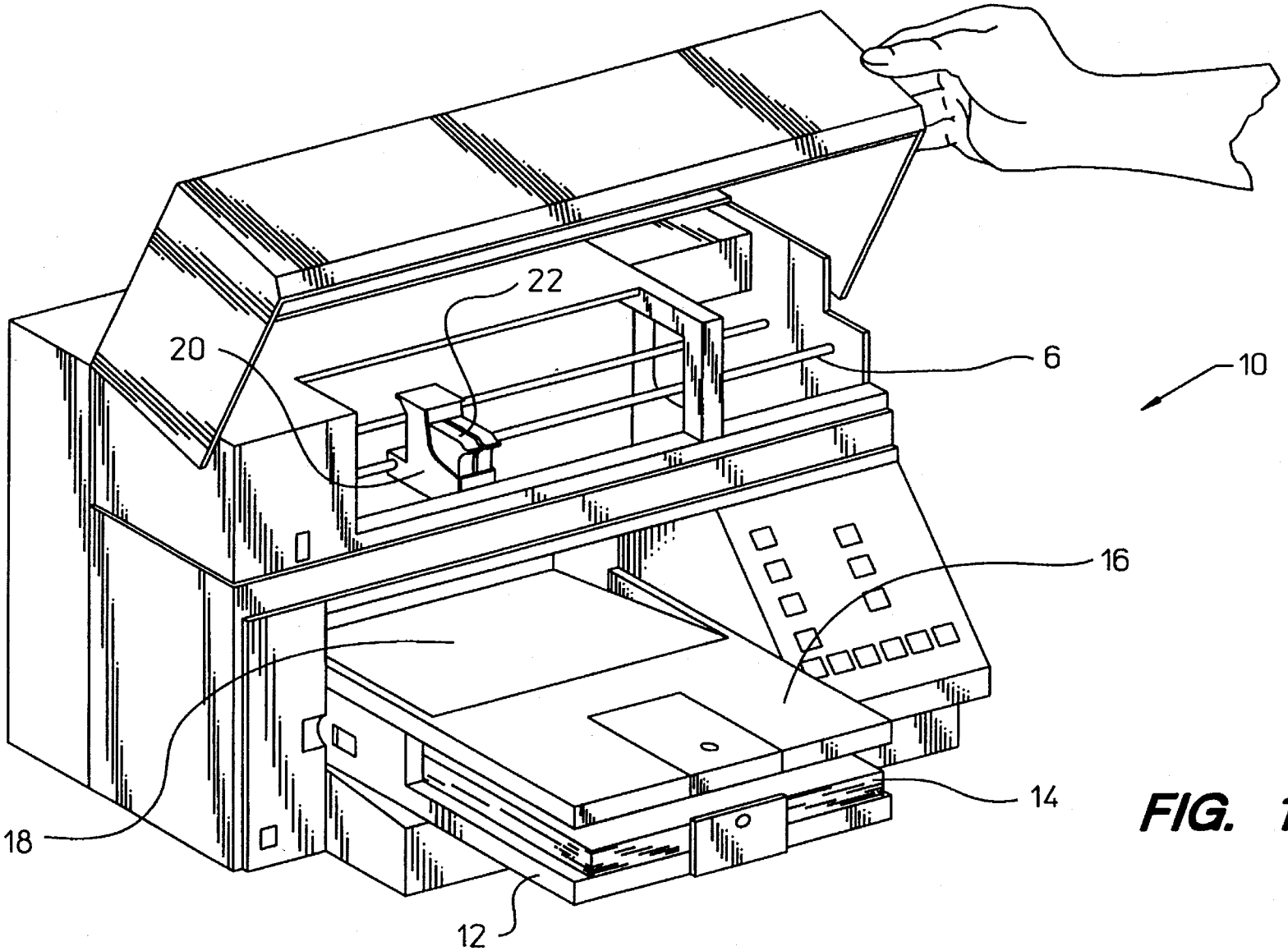
FIG. 1 is a perspective view showing a inkjet printer incorporating the present invention.
Figure 3:
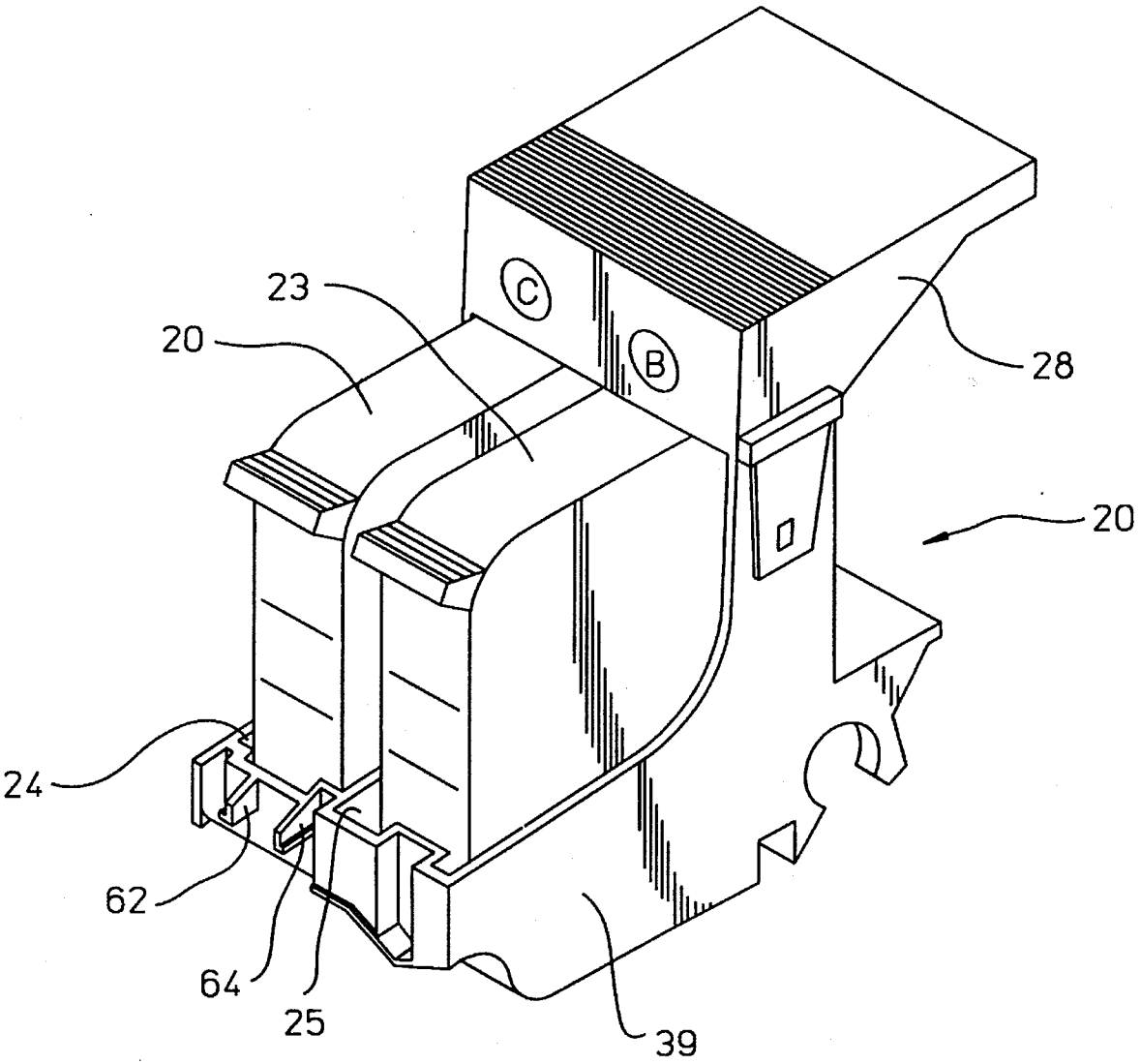
FIG. 3 is a perspective view of a inkier printer carriage.

FIG. 1 shows a color inkjet printer 10 incorporating the present invention. In particular, inkier printer 10 includes a movable carriage assembly 20 supported on slider rod 6 at the rear and a slider bar (not shown) at the front. Inkjet printer 10 also is provided with input tray 12 containing a number of sheets of paper or other suitable ink receiving medium 14, and an upper output tray 16 for receiving the printed media 18. As shown in FIG. 3, movable carriage 20 includes two cartridge receptacles 24, 25 for receiving ink jet printer cartridges 22, 23.

Figure 2:
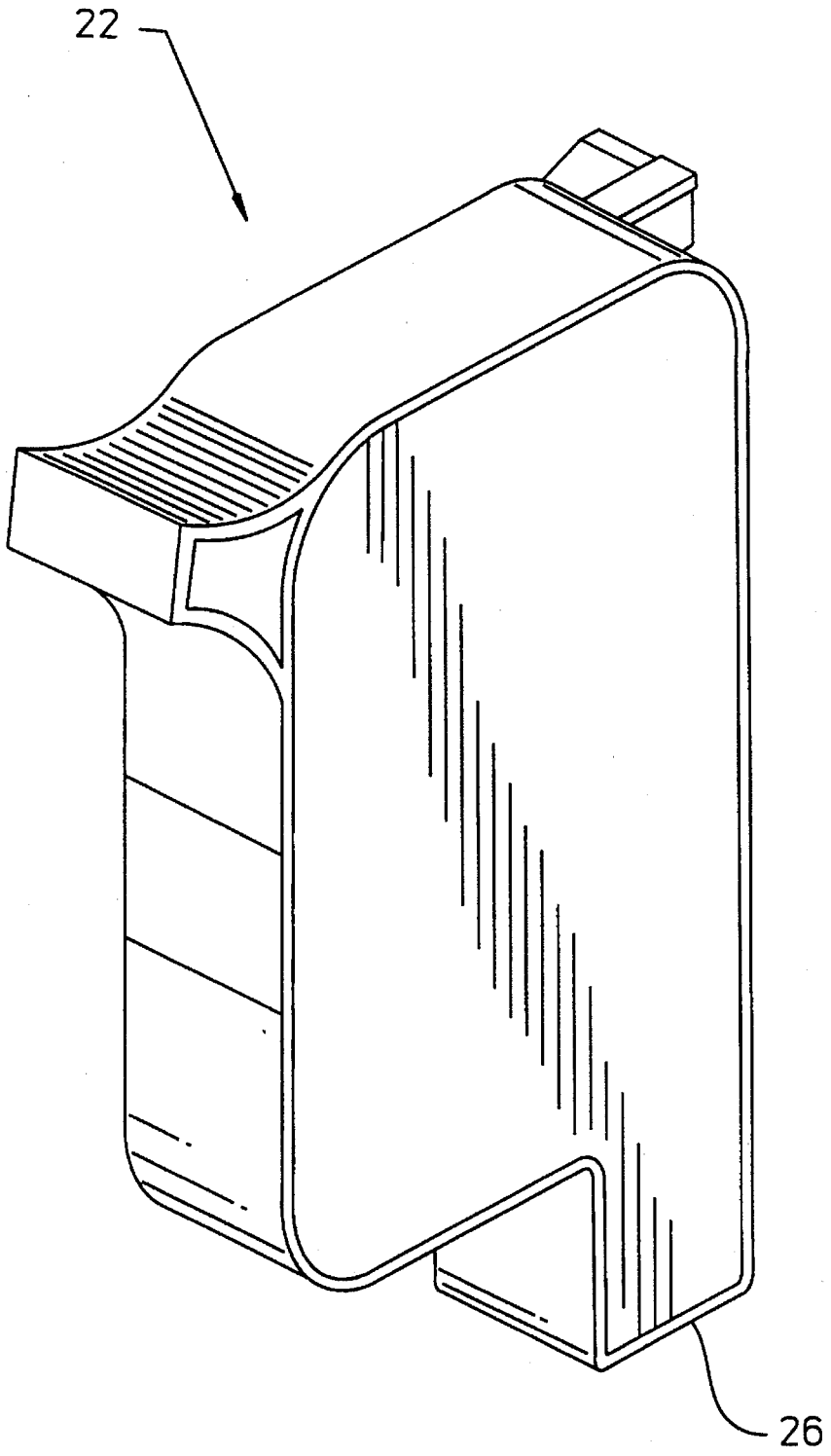
FIG. 2 is a perspective view of a inkjet cartridge in accordance with this invention.

FIG. 2 is a more detailed illustration of an inkjet pen cartridge 22 that stores ink and has a printhead 26 which when activated by firing pulses causes ink to be ejected from nozzles in the inkjet pen printhead 26. At the bottom of printhead 26 is an encapsulant (not shown) which covers the wire leads at the edges of the printhead 26. The encapsulant is closer to the media than the nozzles in the printhead 26. As used herein, the pen-to-paper or printhead-to-paper spacing or distance refers to the encapsulant to paper spacing or distance. FIG. 3 illustrates two inkjet pen cartridges 22, 23 installed in two ink cartridge receptacles 24, 25 in carriage assembly 20 and with carriage cover 28 installed on top of carriage assembly 20.

Figure 4:
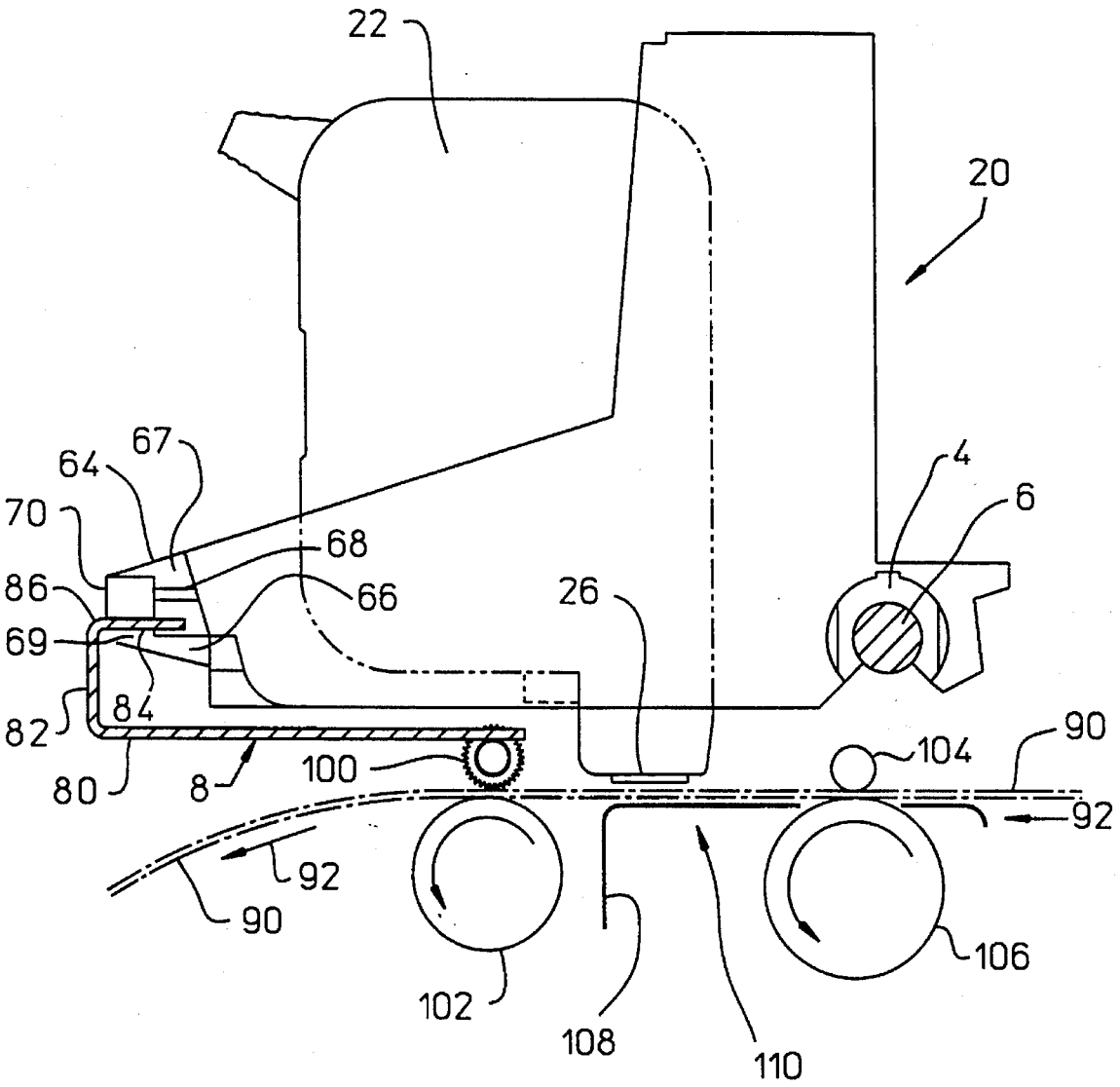
FIG. 4 is a side elevation view of the carriage of FIG. 3 showing the slider rod and slider bar supports and a portion of the media feed path of the printer of FIG. 1 partly in cross-section.

FIG. 4 shows carriage assembly 20 mounted for sliding movement on slider rod 6 and slider bar 8 which each extend transversely of the path of movement of the paper or other printing medium through the printer. In the embodiment shown, the carriage 20 is supported in the rear on slider rod 6 by two laterally spaced bushings 4 in the lower rear portion of the carriage 20 and in the front by slider bar 8 the upper surface of which comprises a carriage support surface 86 which engages the lower surface of the slider shoe 70 to support the front portion of the carriage 20.

Figure 6:
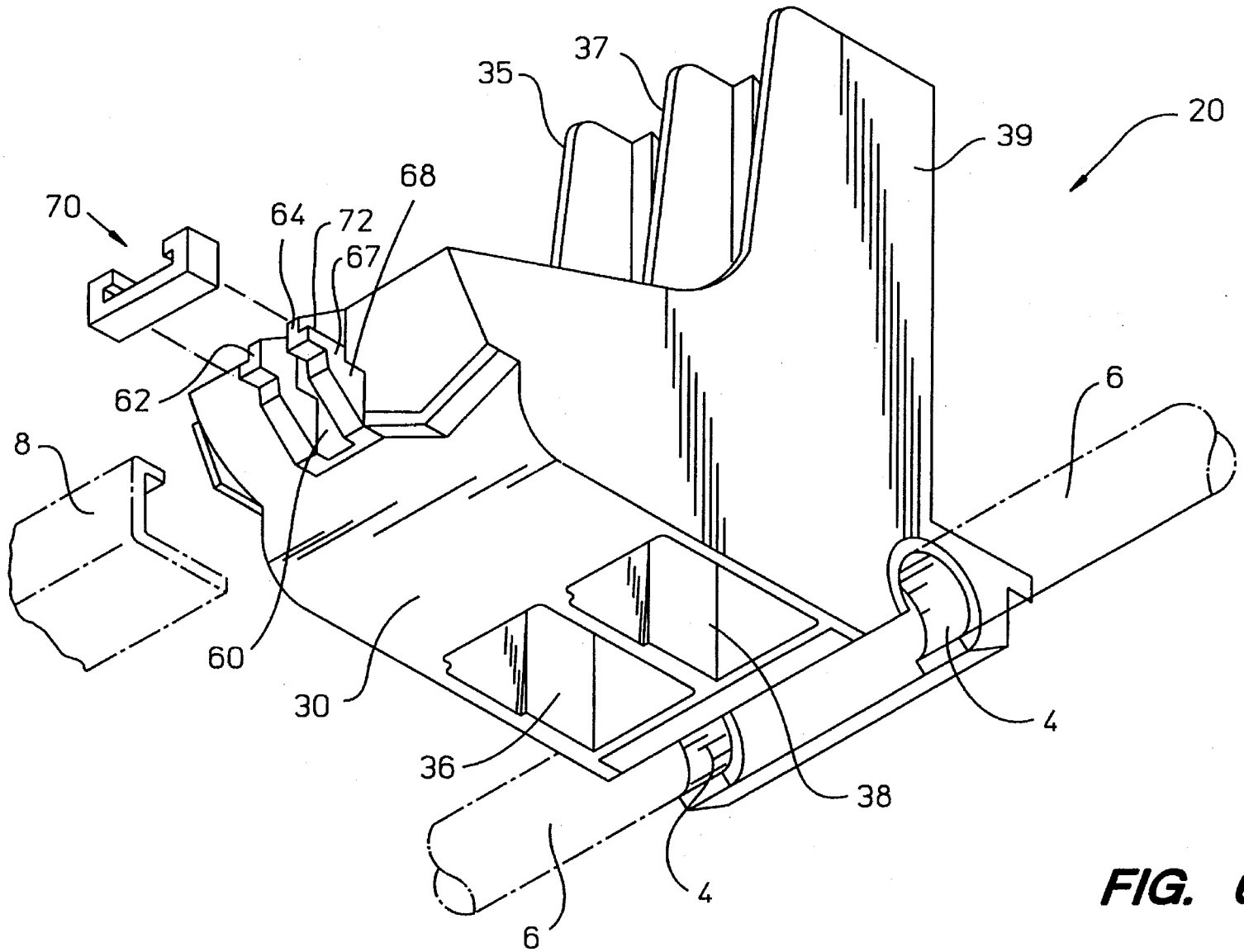
FIG. 6 is a perspective view showing the underside and the right hand side of a printer carriage mountable for sliding movement on a slider rod and slider bar shown in phantom.

FIG. 6 shows a perspective view from the bottom front of carriage assembly 20. In the preferred embodiment, two separate inkjet cartridges 22, 23 are provided. One tri-compartment cartridge for cyan, magenta and yellow inks 22 and one single compartment cartridge for black ink 23. The carriage 20 comprises a molded plastic member comprised of three generally L-shaped parallel spaced plates 35, 37 and 39 which define two ink cartridge receptacles 24, 25 therebetween. The ink cartridges 22, 23 have printed circuits mounted on their back walls which receive electrical pulses from the printer carriage 20 to energize the printheads 26 (FIG. 2) eject ink drops therefrom. The carriage 20 also has an integrally formed bottom wall 30 provided with two apertures 36, 38 which receive the narrow snout portion of the ink cartridges 22, 23 containing the printhead 26. Ink is ejected downwardly from nozzles (not shown) in printhead 26 onto the paper or other media.

Figure 5:
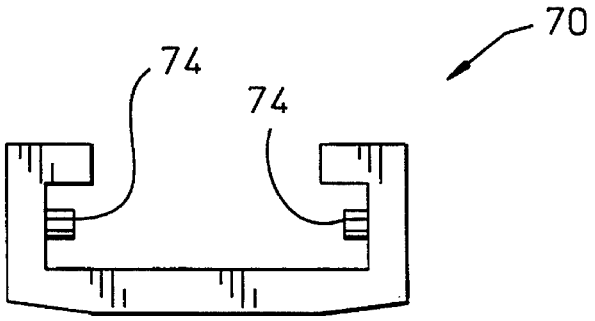
FIG. 5 is an enlarged view of the slider shoe used on the carriage.

Referring to FIGS. 4, 5 and 6, each of the two upper slider bosses 62, 64 on the front wall of carriage 20 has a vertically extending web 67 and an outwardly extending horizontal flange 68 for the purpose of receiving replaceable shoe 70. Each of the flanges 68 has a slight indent (not shown) for reception of a projecting dimple 74 on two opposed flanges of the slider shoe 70 which comprises a channel shaped plastic section whereby slider shoe 70 can be slipped onto the horizontal flanges 68 of the upper bosses 62, 64 wherein the dimples 74 (FIG. 5) will retain the slider shoe 70 on the flanges 68 by engaging the indents 72 therein.

The lower boss 66 on the front wall of the carriage 20 preferably has an upper contact lip 69 (FIG. 4) which does not extend the full length of the boss. The lip 69 and the lower surface of the wear slider shoe 70 are spaced a distance to closely slideably receive an upper flange of the slider bar 8.

Referring to FIG. 4, the slider bar 8 preferably is fabricated from a single piece of sheet metal formed as a channel member having a relatively wide lower flange 80, a vertically extending connecting web 82 and a relatively narrow horizontally extending upper flange 84, the upper surface of which comprises a carriage support surface 86 which engages the lower surface of the slider shoe 70 to support the front portion of the carriage 20. Preferably, the carriage support surface 86 has a high molecular weight polyethylene coating thereon. This coating may be conveniently applied as a strip of tape although other means lubricating the support surface 86 of the slider bar can of course readily be devised by persons skilled in the art.

Referring to FIG. 4, a small portion of the paper path through the printer 10 is illustrated. Each cartridge 22, 23 is supported above the media 90 by the carriage assembly 20 and cartridge receptacles 24, 25 such that printhead 26 is maintained an appropriate printhead-to-media distance from the media 90. The paper 90 is picked from the input tray 12 (FIG. 1) and driven into the paper path in the direction of arrow 92. The leading edge of the paper 90 is then fed into the nip between drive roller 106 and idler or pinch roller 104 and is driven into the print zone 110. A grill screen 108 supports the paper 90 as it is passed through the print zone 110 under printhead 26. After the paper passes through the print area 110 it encounters output roller 102, which propels the media 90 into the output tray 16 (FIG. 1). The drive roller 106 and output roller 102 maintain the print media 90 in a taut condition as it passes under the printhead 26, and advances in a direction perpendicular to the carriage 20 axis defined by slider rod 6.

In the print zone 110, printing onto the upper surface of the media 90 occurs by stopping the drive and output rollers 106, 102, moving the carriage 20 along a swath, and firing the ink cartridges to print a desired swath on the media surface. After printing the desired swath on the media 90 is completed, the drive and output rollers 106, 102 are actuated and the media 90 is driven forward by a swath length, and swath printing commences again.

Figure 7:
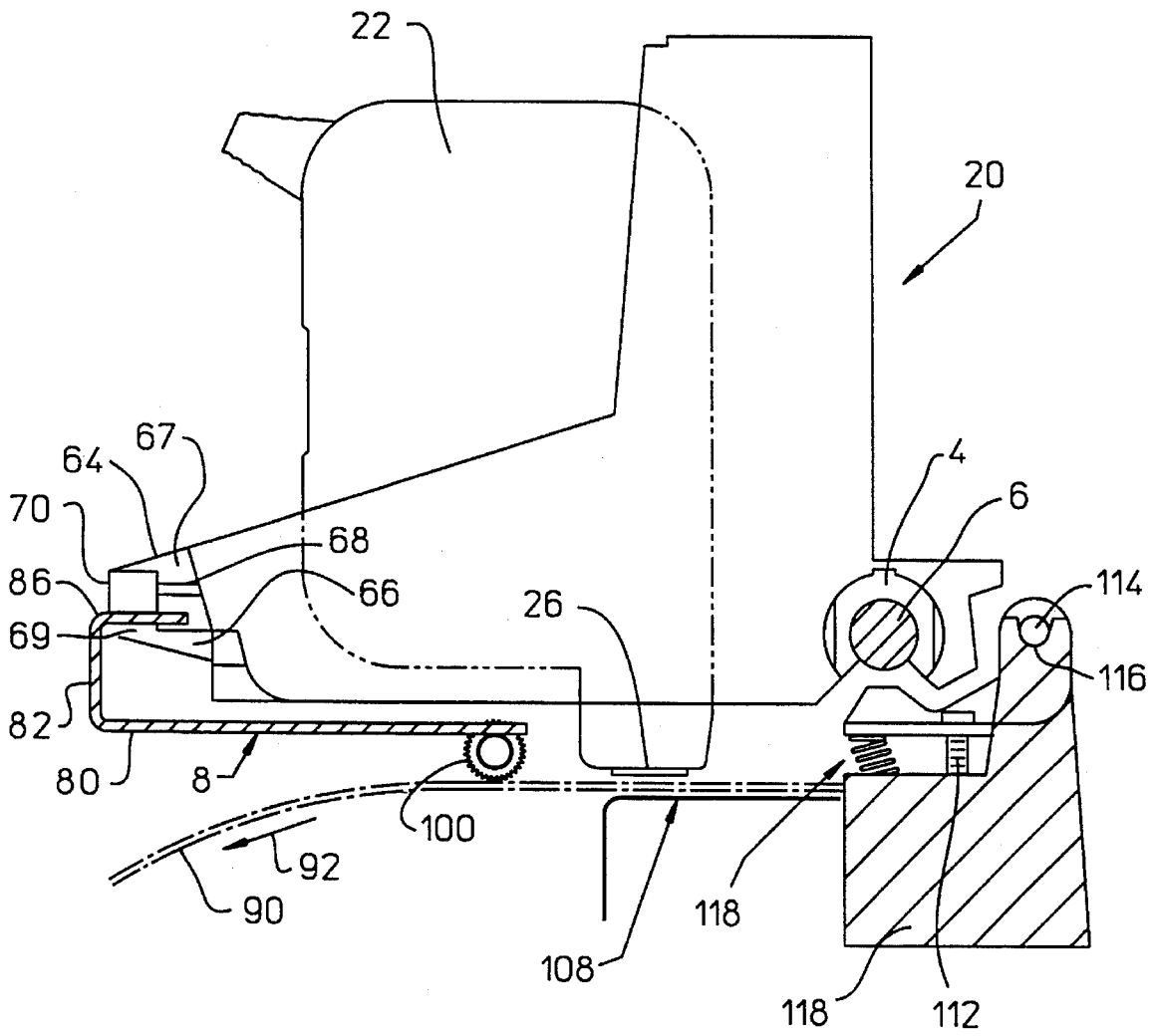
FIG. 7 is a side view, partly in cross-section, showing the carriage assembly and the printhead-to-media distance adjustment mechanism.

Referring to FIG. 7, the slider rod 6 is supported at two midpoints by two stamped sheet metal parts called rod mounts 112. Each rod mount 112 has a dowel pin 114 located on its upper back portion which are inserted in a groove 116 in the upwardly extending portion on the left and right printer chassis 118. The front of the rod mounts 112 on the left and right of the printer rest on adjustment springs 120 which are held with adjustment screws 122. By turning adjustment screws 122 at each side of the printer chassis while moving the carriage 20 to the left and right of the print zone the printhead-to-media distance can be adjusted. The sum of all the tolerances associated with each individual printer part exceeds the tolerance on printhead-to-media distance required to obtain the desired text print quality. Hence, it is required to adjust the printhead-to-media distance on every printer.

The establishment of the distance of the inkjet printhead above the paper from a strictly print quality point of view would be to have the printhead nearly brush the paper in order to achieve the maximum text print quality. Setting the ink cartridge so that there is a 0.8 mm printhead to media spacing produces excellent black text print quality, since the black cartridge never completely leaves the edge of the page during text printing. But it is not possible to print graphics at this printhead-to media distance because the printheads often leaves the page during graphics printing and will catch the edge of the paper on their return.

With respect to print quality, printhead-to media distances of 1.0 mm or less above the media are clearly excellent while printhead distances of 2.0 mm or more above the media are clearly unacceptable. Based upon applicable tolerances in a inkjet printer and the necessary compromise when both text and graphics are being printed, a nominal printhead-to media distance of 1.3 to 1.6 mm above the media provides the maximum benefit with respect to black text print quality while maintaining adequate clearance above the media during graphics printing.

Figure 8:
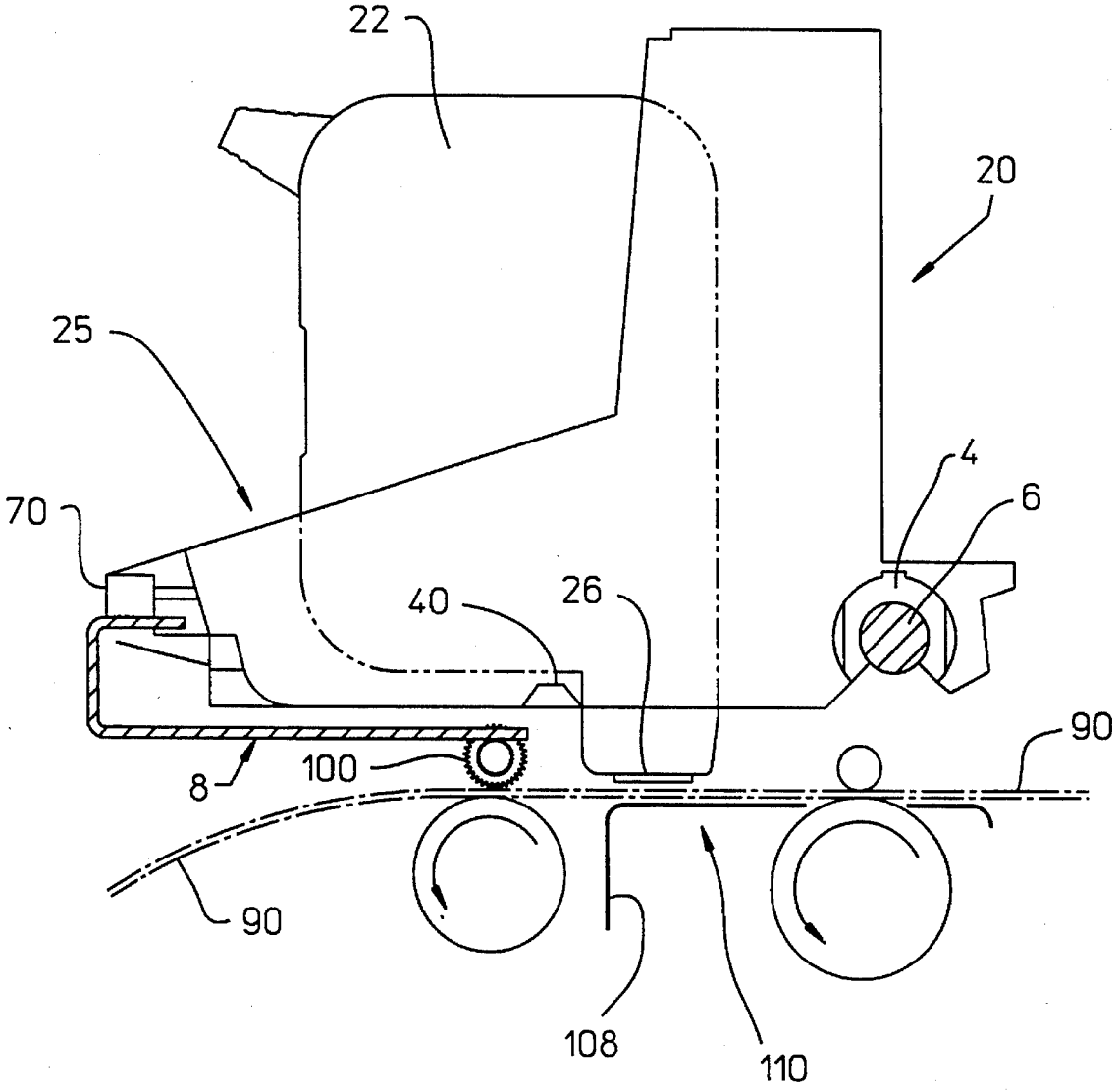
FIG. 8 is a side elevation view of the color cartridge inserted in the carriage of FIG. 3 shown partly in cross-section.
Figure 9:
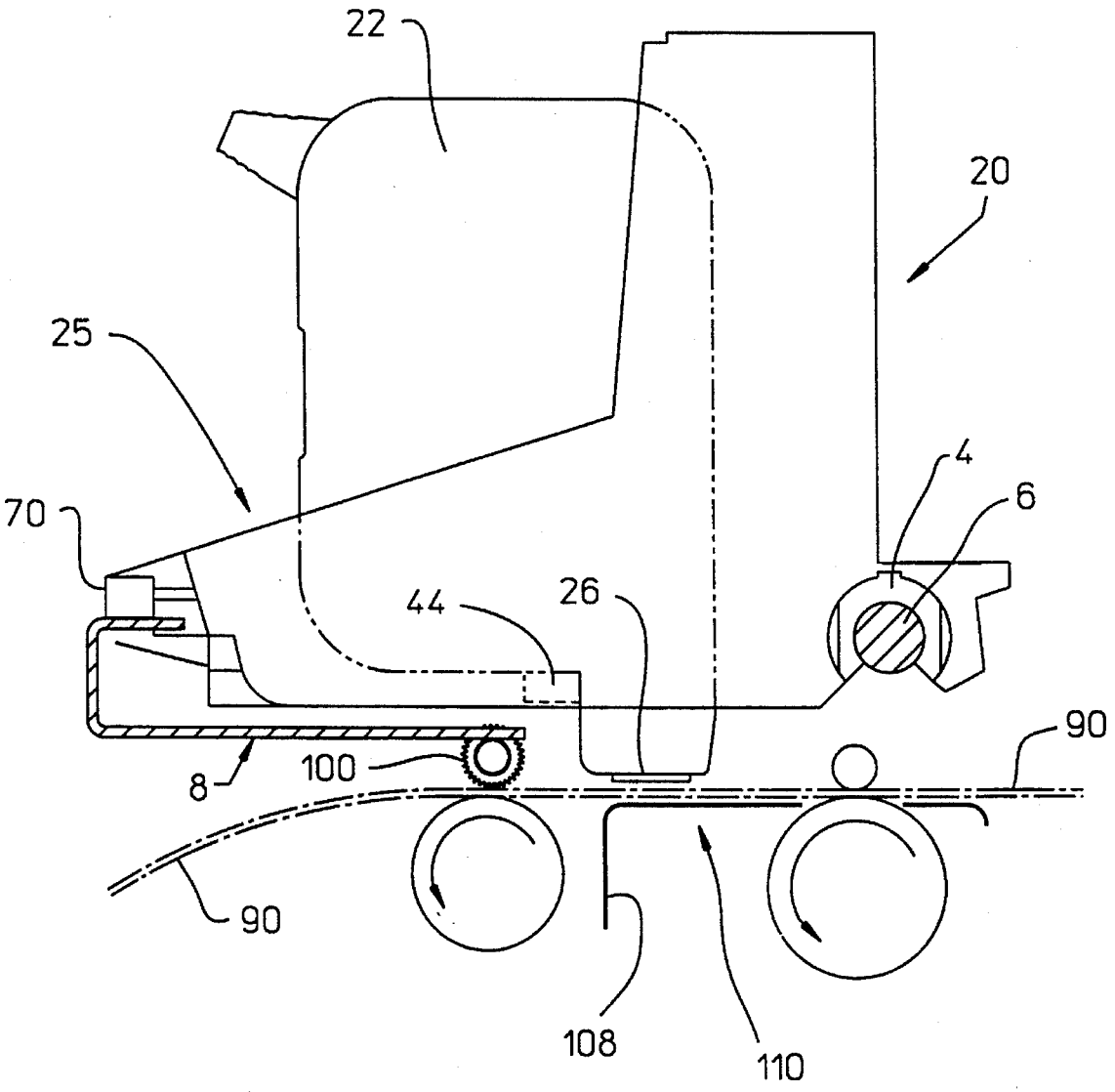
FIG. 9 is a side elevation view of the black cartridge inserted in the carriage of FIG. 3 shown partly in cross-section.
Figure 10:
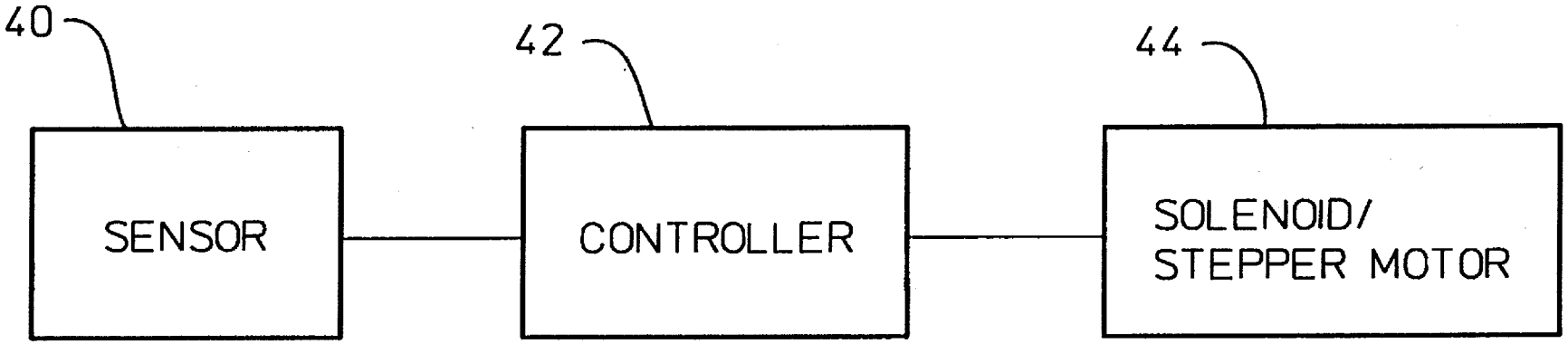
FIG. 10 is a schematic of the printhead-to-media control system.

Since the black print quality is more sensitive to printhead to media distance than is color image quality, the ability to decrease the black printhead-to-media distance when printing only text, will greatly increase black text quality and therefore overall output quality is optimized. Referring to FIGS. 8, 9 and 10 when the color print cartridge 22 is inserted into the receptacle 24 of carriage 20 the sensor 40 located in receptacle 24 activates the electromechanical link shown in FIG. 10 which reversibly increases the printhead-to-media distance of the black print cartridge 23 by activating the push-pull solenoid 44 located in receptacle 25. When the color print cartridge 22 is removed from the receptacle 24 of carriage 20 the sensor 40 detects this and activates the electromechanical link which reversibly decreases the printhead-to-media distance of the black print cartridge 23 by activating the push-pull solenoid 44. Alternatively, the push-pull solenoid could be any other suitable means for providing incremental movement such as a stepper motor and cam arrangement. Also, datum stops can be provided to precisely locate the upper and lower position of the black print cartridge 23 in carriage 20

Referring to FIG. 10, sensor 40 sends a signal to controller 42 when the color print cartridge is installed in, or removed from, receptacle 24 of carriage 20. The controller activates a push-pull solenoid 44 to move the black print cartridge towards or away from the media depending on the signal from controller 42. While the schematic representation in FIG. 10 shows the sensor 40 and controller 42 as being separate, one skilled in the art will recognize that the controller 42 may be part of the sensor 40.

Alternatively, when color print cartridge 22 is inserted in receptacle 24 for the color print cartridge 22 in carriage 20 a mechanical link (not shown) could be activated that reversibly moves the black print cartridge 23 away from the paper. When color print cartridge 22 is removed from its receptacle 24, the mechanical link reversibly moves the black pen cartridge closer to the paper.

Thus, in accordance with the present invention, the receptacle for the color print cartridge has either a mechanical or electrical sensor for providing feedback to the receptacle for the black print cartridge so that when color print cartridge is inserted, the printhead-to-media distance of the black print cartridge is increased and when the color print cartridge is removed the black print cartridge printhead-to-media is distance decreased to the optimum printhead-to-media distance for printing black text.

Accordingly, this invention enables the black printhead in a multiple cartridge, or exchangeable an cartridge, color inkjet printer to be as close to the media as possible so that black text print quality will be optimized. Since black text print quality is more sensitive to printhead-to-media distance than is color graphics quality, the overall print quality of both black text and color graphics is optimized.

What is claimed is:

1. An inkjet printer comprising:

a carriage including a black pen receptacle and at least one color pen receptacle;

a black pen contained within said black pen receptacle;

sensing means for sensing whether an optional color pen is contained within said color pen receptacle; and adjusting means responsive to said sensing means for adjusting a height of said black pen relative to said carriage as a function of whether or not said sensing means senses said optional color pen within said color pen receptacle.

2. A method for improving print quality in an inkjet printer having a first pen and an optional second pen each having a respective printhead for applying liquid ink to a sheet of media supported by the printer at a predetermined location inside the printer and each being adapted for installation in a common carriage assembly, the method comprising the steps of:

locating a cartridge positioning means for positioning a pen in a first cartridge receptacle on said common carriage assembly relative to the sheet of media at a first position such that when the first pen is installed in the first cartridge receptacle, the printhead of the first pen is at a predetermined first distance above said predetermined location, said first distance being suitable for a first print mode which does not require the optional second pen;

determining whether the optional second pen is currently installed in the carriage assembly;

if the optional second pen is not currently installed, maintaining the cartridge positioning means at said first position; and if the optional second pen is currently installed in the carriage assembly, relocating the cartridge positioning means to a second position different from said first position such that the printhead of a pen installed in the first cartridge receptacle is at a predetermined second distance above said predetermined location, said second distance being different than said first distance and suitable for a second print mode which requires the optional second pen, whereby said print quality is improved by changing the printhead to media distance of the pen in the first receptacle when the optional pen is installed for use with the second print mode, to thereby obtain a variable print head to media distance suitable for more than one type of pen and more than one print mode.

3. The method of claim 2, wherein the first pen is a black pen, the first print mode is a black text mode, the optional second pen is a colored pen, and the second print mode is a colored graphics mode.

4. The method of claim 2, wherein the carriage assembly includes a second receptacle for the second pen, whereby both pens may be simultaneously installed in the carriage.

5. The method of claim 4, wherein the printhead to media distance of the first pen is increased when the second pen is installed.

* * * * *